United States Patent [19]

Voss et al.

[11] Patent Number: 4,809,767

[45] Date of Patent: Mar. 7, 1989

[54] COUNTERGRAVITY CASTING APPARATUS

[75] Inventors: Karl D. Voss, Standish; James B. Mercer; Anthony C. Greanias, both of Saginaw, all of Mich.

[73] Assignee: General Motors Corporation, Detroit, Mich.

[21] Appl. No.: 211,023

[22] Filed: Jun. 24, 1988

[51] Int. Cl.[4] ..... B22D 18/06

[52] U.S. Cl. ..... 164/154; 164/63; 164/255; 164/256; 164/339; 164/341

[58] Field of Search ..... 164/154, 457, 255, 256, 164/339, 341, 342, 63, 65, 137

[56] References Cited

U.S. PATENT DOCUMENTS

| | | | |
|---|---|---|---|
| 2,923,040 | 2/1960 | Goodwin et al. | 164/63 |
| 4,616,691 | 10/1986 | Voss | 164/63 X |
| 4,745,962 | 5/1988 | Mercer et al. | 164/255 |

*Primary Examiner*—Nicholas P. Godici
*Assistant Examiner*—J. Reed Batten, Jr.
*Attorney, Agent, or Firm*—Lawrence B. Plant

[57] ABSTRACT

Apparatus for the countergravity casting of molten metal by immersing of gas-permeable multi-piece mold in an underlying pot of molten metal includes a motor actuated plunger for pressing the pieces into sealing engagement with each other without the need for glue therebetween and for resisting destructive flexure of the mold incident to the application of casting vacuum thereto.

6 Claims, 1 Drawing Sheet

COUNTERGRAVITY CASTING APPARATUS

This invention relates to apparatus for the vacuum, countergravity casting of metal in gas-permeable, shell molds immersed in a pot of molten metal and, more particularly, to mounting the mold to the vacuum chamber so as to eliminate the need to adhesively bond the mold portions (i.e., cope, drag, cheeks, etc.) together.

BACKGROUND OF THE INVENTION

The vacuum, countergravity, shell mold casting process is particularly useful in the making of thin-walled, near-net-shape castings and involves: sealing a bottom-gated mold, having a gas-permeable upper portion, to the mouth of a vacuum chamber such that the chamber confronts the upper portion; immersing the underside of the mold in an underlying melt; and evacuating the chamber to draw melt up into the mold through one or more of the gates in the underside thereof. Such a process is shown in U.S. Pat. No. 4,340,108 wherein the mold comprises a resin-bonded-sand shell having an upper cope portion and a lower drag portion sealingly mounted to the mouth of the vacuum chamber by means of spring clips. U.S. Pat. No. 4,340,108 seals the mold to the vacuum chamber atop the cope such that the parting line between the mold halves lies outside the vacuum chamber. U.S. Pat. No. 4,632,171 seals the mold to the mouth of the vacuum chamber atop the drag such that the parting line between the cope and drag falls within the vacuum chamber. U.S. Pat. No. 4,658,880 mounts the mold to the vacuum chamber by means of a plurality of reciprocable and rotatable shafts having self-tapping threads on the lower ends thereof engaging mounting sites atop the mold. Reversible motors rotate the shafts so as to screw the threads into engagement/disengagement with the mounting sites to mount/demount the mold to/from the vacuum chamber. Screwing of the threads into the mounting sites draws the mold into sealing engagement with the mouth of the vacuum chamber. Chandley, G. D. *Automatic Countergravity Casting of Shell Molds,* Modern Casting, October 1983, pages 29–31, mounts round molds to a round vacuum chamber wherein the inside surface of the vacuum chamber includes self-tapping threads which screw into the periphery of the round mold. U.S. patent application Ser. No. 147,863 filed Jan. 25, 1988, describes a technique for mounting the mold to the vacuum box via a plurality of T-bar keepers engaging anchoring cavities in the mold.

When the aforesaid mold-chamber arrangements are used with thin molds having more than about 400 square inches of mold confronting the vacuum chamber, there is a tendency for the molds to bow or flex into the chamber when the casting vacuum is drawn in the chamber. This flexure can destroy the mold by forming cracks therein if not total fracture (i.e., implosion) of the mold into the chamber.

The aforesaid patents/publication all disclose molds wherein the upper and lower halves are glued together. The gluing process is expensive and time consuming and elimination thereof would improve the efficiency and economics of the process. Two techniques for eliminating gluing and resisting destructive flexure of the mold are the subject of copending U.S. patent application Ser. Nos. 211,020 and 211,024 filed concurrently herewith and assigned to the assignee of this application.

It is an object of the present invention to provide improved apparatus for the vacuum, countergravity casting of shell molds including means for securing the upper mold portion into sealing engagement (sans glue) with the lower mold portion after the mold has been mounted to the mouth of the vacuum box and for resisting destructive flexure of the mold during casting. It is a further object of the present invention to provide such improved apparatus with means for automatically controlling the securing of the mold members together so as to provide such sealing and resistance without dislodging the mold from the chamber. These and other objects and advantages of the present invention will become more readily apparent from the detailed description thereof which follows.

BRIEF DESCRIPTION OF THE INVENTION

The present invention contemplates countergravity casting apparatus of the type described above including means to press the mold members sealingly together and to resist destructive flexure of the molds when the casting vacuum is drawn. More specifically, apparatus in accordance with the present invention includes: a mold having a porous, gas-permeable upper shell and a bottom-gated lower portion secured to the upper shell and adapted for immersion in an underlying pot of molten metal; a vacuum box defining a chamber confronting the upper shell for evacuating the mold through the shell, which box comprises (1) a continuous wall having a peripheral edge on the underside thereof for sealingly engaging the mold and (2) a ceiling overlying the mold; means for mounting and demounting the mold to the vacuum chamber; at least one recedable plunger projecting from inside the box and pressing the shell into sealing engagement with the lower portion; a motor for causing the plunger to so press on the shell; and means for controlling the motor to provide sufficient force on the plunger to effect the seal between the upper and lower portions and to resist destructive flexure of the mold but without dislodging the mold from the mouth of the chamber.

The plunger is recedable into the chamber so as not to apply any substantial force on the mold at the time it is being mounted to the chamber. Hence the plunger may simply be pushed up into the chamber by the mold itself during the mounting operation. Preferably, however, the plunger is positively retracted up into the chamber out of the way of the mold by reversing the motor that extends the plunger and presses it against the upper shell. Appropriate controls are provided to control the force applied by the motors so that it does not exceed the forces holding the mold in place in the mouth of the vacuum chamber yet is sufficiently high to insure a cope-to-drag seal and prevent mold breakage. The amount of force applied by the motors during casting will generally be equal to or slightly less than the force acting on the mold as a result of the vacuum drawn in the chamber. When, for example, a pneumatic motor (e.g., an air cylinder) is used, a pressure switch or the like, may be coupled to the inlet line of the air cylinder to maintain the pressure applied to the cylinder below a predetermined value which is calculated based on the area of the mold and the maximum vacuum that will be applied to that area by the vacuum chamber. Preferably, however, the control means will include a sensor which is responsive to the vacuum in the chamber and varies the air pressure applied to the air motor to keep the system in balance. Apparatus in accordance with the present invention can be adjusted to accommodate a variety of molds of different weights and thicknesses by simply changing the control settings and without having to replace the chamber or any part thereof.

BRIEF DESCRIPTION OF SPECIFIC EMBODIMENTS

The invention may better be understood when considered in the light of the following detailed description of certain specific embodiments thereof which is given hereafter in conjunction with the several drawings in which:

FIG. 1 is a partially sectioned, elevational view of a countergravity casting apparatus according to the present invention; and FIG. 2 is a sectioned view in the direction 2—2 of FIG. 1.

DETAILED DESCRIPTION OF SPECIFIC EMBODIMENTS

Figure 1:
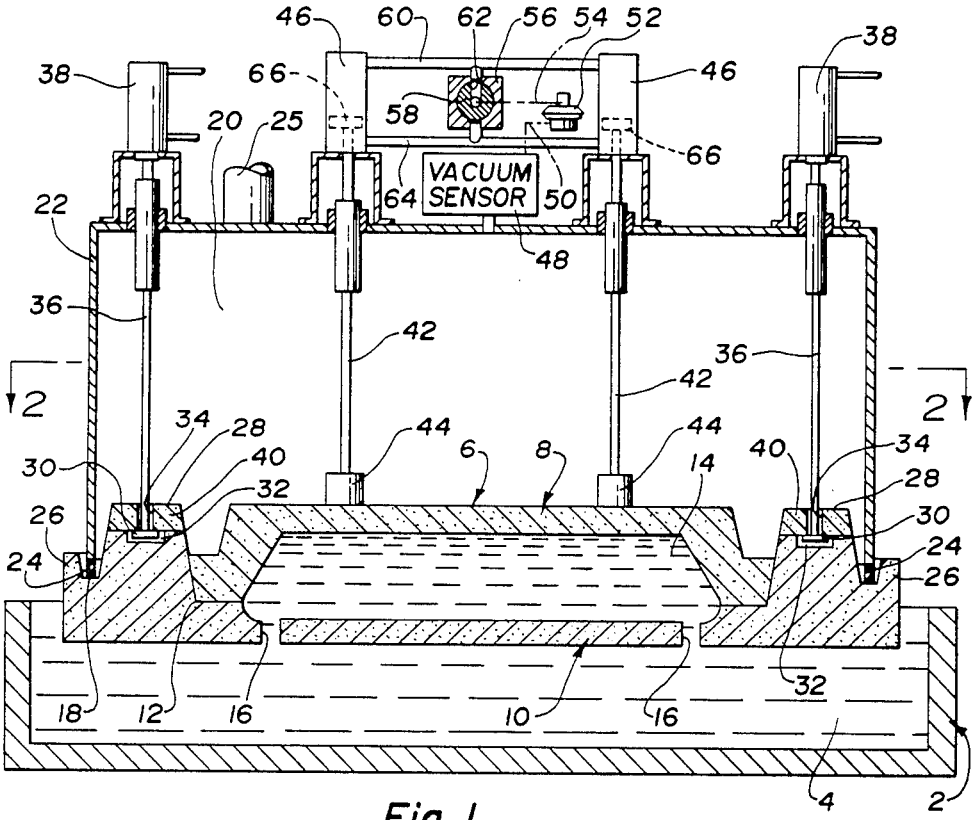
Figure 2:
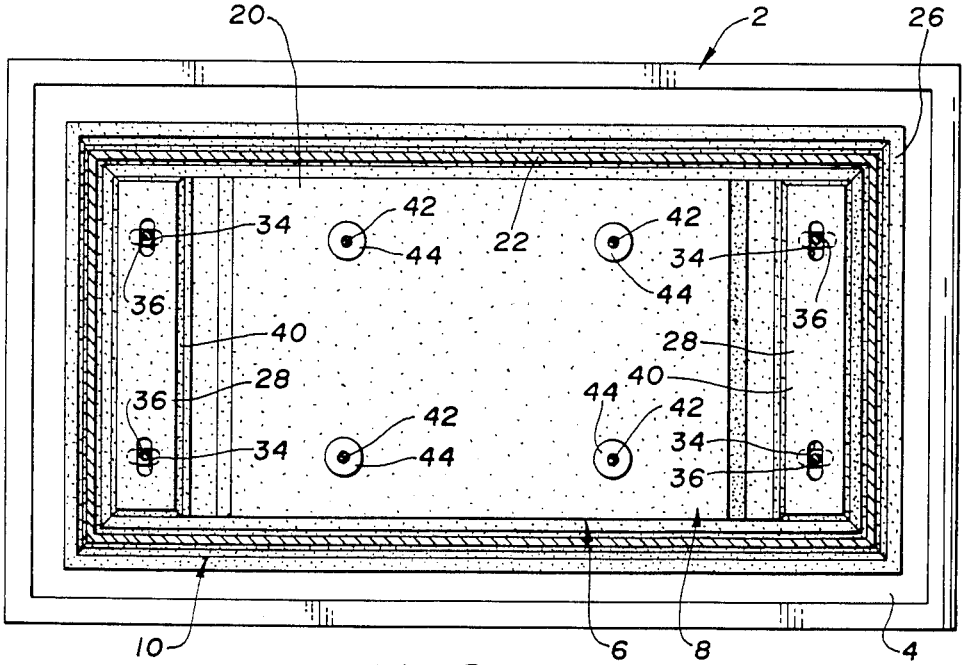

FIG. 1 depicts a pot 2 of metal melt 4 which is to be drawn up into a mold 6 comprising a gas-permeable upper shell portion 8 and a lower portion 10 joined at a parting line 12 and defining a mold cavity 14 therebetween. The lower portion 10 includes a plurality of ingates 16 on the underside thereof for admitting melt to the mold cavity 14 when it is evacuated through the shell 8. The lower portion 10 of the mold 6 is sealed to the mouth 18 of a vacuum chamber 20 (i.e., defined by vacuum box 22) via a compressible seal 24 (e.g., high temperature rubber, ceramic rope, etc.) along the lower peripheral edge of the box 22 such that the upper portion 8 is encompassed by the chamber 20. The vacuum chamber 20 is communicated to a vacuum source (not shown) via conduit 25. The upper portion 8 of the mold 6 comprises a gas-permeable material (e.g., resin-bonded sand) which permits gases to be withdrawn from the casting cavity 14 when a vacuum is drawn in the chamber 20. The lower portion 10 of the mold 6 may conveniently comprise the same material as the upper portion 8 or other materials, permeable or impermeable, which are compatible with the upper portion material. The lower portion 10 includes an upstanding levee 26 surrounding the seal 24 and isolating it from the melt 4 as described in U.S. Pat. No. 4,745,962 and assigned to the assignee of the present invention.

The lower portion 10 includes a plurality of anchoring sites 28 engaged by keepers 30 of the type described in the aforesaid U.S. patent application Ser. No. 147,863 which is incorporated herein by reference to the extent of its disclosure of a preferred means for mounting the mold 6 to the box 22. Other mounting means such as disclosed in the other references (supra) 4,632,171 would, of course, also be acceptable. As described in U.S. patent application Ser. No. 147,863, the lower portion 10 of the mold 6 includes a plurality of anchoring cavities 32 adapted to receive T-bar keepers 30 via slots 34 in the mold portion overlying the cavity 32. A 90° rotation of the shafts 36 by air motors 38 cause the T-bars 30 to engage the underside of the shelves 40 overhanging the cavities 30 to secure the mold to the box 22.

In accordance with the present invention, the upper shell portion 8 is pressed into sealing engagement with the lower portion 10 (i.e., at the parting line 12) by means of a plurality of plungers 42. Feet 44 on plungers 42 distribute the force of the plungers 42 more widely across the top of the shell 8 to prevent penetration/puncture of the upper shell portion 8. The plungers 42 are actuated by motors 46 (i.e., here shown as air cylinders 46) which serve to retract the plungers 42 when the mold 6 is being anchored to the box 22 and thereafter to extend the plunger to engage the upper portion 8 and apply sufficient force thereto to press the upper portion 8 into sealing engagement with the lower portion 10, as well as prevent destructive flexing of the mold 6 inwardly of the chamber 20 when the casting vacuum is drawn. The force applied by the plungers 42, however, will not be so great as to dislodge the mold 6 from the mouth 18 of the box 22 or break the seal formed thereat.

In accordance with a preferred embodiment of the present invention, a sensor 48, responsive to the vacuum in the chamber 20, is connected to the chamber 20 and has a DC voltage output 50 which varies with the pressure in the chamber 20. The output 50 of the sensor 48 is the input to a motor controlled pressure regulator 52 which controls the pressure of the gas (e.g., air) in the input line 54 to a motor controlled diverter valve 56. As shown in FIG. 1, the spool 58 of the diverter valve 56 is positioned to direct the pressurized air to the air cylinders 46 via inlet lines 60 to extend the plungers 42 into pressing engagement with the shell 8 as described above. Prior to extending the plungers 42 and at the time that the mold 6 is positioned in the mouth 18 of the box 22, the spool 58 of the diverter valve 56 is rotated 180° so as to align the outlet 62 of the spool 58 with the lines 64 for directing the pressurized air to the opposite side of the pistons 66 of the air cylinders 46 and thereby retract the plungers 42 up into the vacuum box 22 and out of the way of the mold 6. Alternatively, it is not necessary to positively retract the plungers 42 but rather to simply vent the air cylinders 46 so that the plungers 42 may readily recede into the chamber by being pushed back up by the mold 6 itself as it is positioned in the vacuum chamber 20.

While the invention has been disclosed primarily in terms of specific embodiments thereof it is not intended to be limited thereto but rather only to the extent set forth hereafter in the claims which follows.

The embodiments of the invention in which an exclusive property or privilege is claimed are defined as follows:

1. Apparatus for the vacuum countergravity casting of molten metal comprising:

a mold comprising a porous gas-permeable upper shell at least in part defining a mold cavity and a lower portion adapted for immersion into a pot of said metal underlying said mold, said lower portion including at least one gate in the underside thereof for admitting said metal into said cavity upon evacuation of said cavity;

a vacuum box defining a vacuum chamber confronting said upper shell for evacuating said cavity through said shell, said box including a peripheral edge on the underside thereof defining a mouth receiving and sealingly engaging said lower portion;

means for mounting said mold to said mouth with said lower portion in sealing engagement with said edge;

at least one plunger projecting from said box and recedable into said chamber for permitting mounting of said mold to said mouth and for thereafter pressing of said shell against said lower portion during said evacuation;

a motor for actuating said plunger to effect said pressing; and means for controlling said motor so as to apply sufficient force on said plunger to sealingly engage said shell and said lower portion and to prevent destructive flexure of said mold during said evacuation but insufficient force to dislodge said mold from said mouth.

2. Apparatus for the vacuum countergravity casting of molten metal comprising:

a mold comprising a porous gas-permeable upper shell at least in part defining a mold cavity and a lower portion adapted for immersion into a pot of said metal underlying said mold, said lower portion including at least one gate in the underside thereof for admitting said metal into said cavity upon evacuation of said cavity;

a vacuum box defining a vacuum chamber confronting said upper shell for evacuating said cavity through said shell, said box including a peripheral edge on the underside thereof defining a mouth receiving and sealingly engaging said lower portion;

means for mounting said mold to said mouth with said lower portion in sealing engagement with said edge;

at least one plunger projecting from said box and movable between retracted and extended positions;

a motor for moving said plunger between said positions; and means for controlling said motor so as to cause said plunger to retract into said chamber for mounting said mold to said box and thereafter to extend and engage said shell with sufficient force to press said shell into sealing engagement with said lower portion and to resist destructive flexure of said mold during said evacuation but insufficient force to dislodge said mold from said mouth.

3. Apparatus for the vacuum countergravity casting of molten metal comprising:

a mold comprising a porous gas-permeable upper shell at least in part defining a mold cavity and a lower portion adapted for immersion into a pot of said metal underlying said mold, said lower portion including at least one gate in the underside thereof for admitting said metal into said cavity upon evacuation of said cavity;

a vacuum box defining a vacuum chamber confronting said upper shell for evacuating said cavity through said shell, said box including a peripheral edge on the underside thereof defining a mouth receiving and sealingly engaging said lower portion;

means for mounting said mold to said mouth with said lower portion in sealing engagement with said edge;

at least one plunger projecting from said box and movable between retracted and extended positions;

a fluid motor for moving said plunger between said positions; and means for controlling the fluid applied to said motor to retract said plunger for mounting said mold to said mouth and thereafter extending and pressurizing said motor sufficiently to press said shell into sealing engagement with said lower portion and to resist destructive flexure of said mold during said evacuation but insufficiently to dislodge said mold from said mouth.

4. Apparatus according to claim 3 wherein said fluid motor comprises a pneumatic cylinder.

5. Apparatus according to claim 3 wherein said control means includes means responsive to the pressure build-up in said motor for triggering cessation of said build-up when said pressure reaches a predetermined cutoff pressure.

6. Apparatus according to claim 3 wherein said control means includes means responsive to the vacuum in said chamber.

* * * * *